US010337092B2

(12) United States Patent
Morohoshi et al.

(10) Patent No.: US 10,337,092 B2
(45) Date of Patent: Jul. 2, 2019

(54) STEEL SHEET

(71) Applicant: NIPPON STEEL & SUMITOMO METAL CORPORATION, Tokyo (JP)

(72) Inventors: Takashi Morohoshi, Kisarazu (JP); Takashi Aramaki, Kitakyushu (JP); Masafumi Zeze, Kitakyushu (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 189 days.

(21) Appl. No.: 14/785,788

(22) PCT Filed: Apr. 24, 2014

(86) PCT No.: PCT/JP2014/061573

§ 371 (c)(1),
(2) Date: Oct. 20, 2015

(87) PCT Pub. No.: WO2014/175381

PCT Pub. Date: Oct. 30, 2014

(65) Prior Publication Data

US 2016/0076123 A1 Mar. 17, 2016

(30) Foreign Application Priority Data

Apr. 25, 2013 (JP) ..... 2013-092408

(51) Int. Cl.
*C21C 1/06* (2006.01)
*C22C 38/00* (2006.01)
(Continued)

(52) U.S. Cl.
CPC ..... *C22C 38/50* (2013.01); *C21C 7/06* (2013.01); *C21C 7/068* (2013.01); *C21D 8/0226* (2013.01);
(Continued)

(58) Field of Classification Search
CPC ..... C22C 29/04; C22C 38/00; C22C 38/001; C22C 38/002; C22C 38/005; C22C 38/02;
(Continued)

(56) References Cited

U.S. PATENT DOCUMENTS 9,051,634 B2 * 6/2015 Morohoshi ..... C21D 9/46
2005/0025658 A1 2/2005 Matsui et al.
(Continued)

FOREIGN PATENT DOCUMENTS

CN 1580312 A 2/2005
CN 102282282 A 12/2011
(Continued)

OTHER PUBLICATIONS

International Search Report, issued in PCT/JP2014/061573, dated Jul. 8, 2014.
(Continued)

*Primary Examiner* — Colleen P Dunn
*Assistant Examiner* — Anthony M Liang
(74) *Attorney, Agent, or Firm* — Birch, Stewart, Kolasch & Birch, LLP

(57) ABSTRACT

A steel sheet according to the present invention includes a predetermined chemical composition, in which amounts of each elements by mass % in the chemical composition satisfy both of expression "0.3000≤{Ca/40.88+(REM/140)/2}/(S/32.07)" and expression "Ca≤0.0058−0.0050×C", and a number density of carbonitrides including Ti which exists independently and has a long side of 5 μm or more is limited to 5 pieces/mm$^2$ or less.

12 Claims, 2 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/50*** | (2006.01) |
| ***C22C 38/14*** | (2006.01) |
| ***C22C 38/54*** | (2006.01) |
| ***C21C 7/06*** | (2006.01) |
| ***C21C 7/068*** | (2006.01) |
| ***C22C 38/08*** | (2006.01) |
| ***C22C 38/12*** | (2006.01) |
| ***C22C 38/16*** | (2006.01) |
| ***C22C 38/22*** | (2006.01) |
| ***C22C 38/28*** | (2006.01) |
| ***C21D 8/02*** | (2006.01) |
| ***C21D 8/04*** | (2006.01) |
| ***C22C 38/24*** | (2006.01) |
| ***C22C 38/26*** | (2006.01) |
| ***C22C 38/42*** | (2006.01) |
| *C21D 9/46* | (2006.01) |

(52) U.S. Cl.

CPC ..... *C21D 8/0263* (2013.01); *C21D 8/0426* (2013.01); *C21D 8/0463* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/22* (2013.01); *C22C 38/24* (2013.01); *C22C 38/26* (2013.01); *C22C 38/28* (2013.01); *C22C 38/42* (2013.01); *C22C 38/54* (2013.01); *C21D 9/46* (2013.01); *C21D 2211/004* (2013.01)

(58) Field of Classification Search

CPC ..... C22C 38/04; C22C 38/06; C22C 38/08; C22C 38/12; C22C 38/14; C22C 38/16; C22C 38/22; C22C 38/24; C22C 38/26; C22C 38/28; C22C 38/42; C22C 38/50; C22C 38/54; C21C 1/06; C21C 1/068; C21D 2211/004; C21D 8/0226; C21D 8/0263; C21D 8/0426; C21D 8/0463; C21D 9/46

See application file for complete search history.

(56) References Cited

U.S. PATENT DOCUMENTS

| | | | |
|---|---|---|---|
| 2011/0274578 | A1 | 11/2011 | Mizuno et al. |
| 2013/0008568 | A1 | 1/2013 | Suwa et al. |
| 2013/0142688 | A1 | 6/2013 | Yamamoto et al. |
| 2014/0241934 | A1 | 8/2014 | Morohoshi et al. |

FOREIGN PATENT DOCUMENTS

| | | | | |
|---|---|---|---|---|
| CN | 102892910 | A | | 1/2013 |
| CN | 103890212 | A | | 6/2014 |
| EP | 2772559 | A1 | | 9/2014 |
| JP | 2000-265238 | A | | 9/2000 |
| JP | 2000-265239 | A | | 9/2000 |
| JP | 2001-329339 | A | | 11/2001 |
| JP | 2002-69566 | A | | 3/2002 |
| JP | 2008-81823 | A | | 4/2008 |
| JP | 2008081823 | A | * | 4/2008 |
| JP | 2008-248293 | A | | 10/2008 |
| JP | 2011-26659 | A | | 2/2011 |
| JP | 2011-68949 | A | | 4/2011 |
| JP | 2012-188745 | A | | 10/2012 |
| JP | 2012-197506 | A | | 10/2012 |
| WO | WO 2013/061652 | A1 | | 5/2013 |

OTHER PUBLICATIONS

Written Opinion of the International Searching Authority, issued in PCT/JP2014/061573, dated Jul. 8, 2014.

Extended European Search Report, dated Sep. 21, 2016, for corresponding European Application No. 14788723.6.

Korean Office Action for Korean Application No. 10-2015-7030918, dated Aug. 29, 2016, with an English translation thereof.

Chinese Office Action and Search Report, dated May 25, 2016, for Chinese Application No. 201480022841.0, including English translation.

* cited by examiner

STEEL SHEET

TECHNICAL FIELD

The present invention relates to a carbon steel sheet in which an amount of C is more than 0.25% and less than 0.50% in tenors of mass %, and particularly relates to the carbon steel sheet to be shaped by punching, hole expanding, forging, or the like.

Priority is claimed on Japanese Patent Application No. 2013-092408, filed Apr. 25, 2013, the content of which is incorporated herein by reference.

BACKGROUND ART

When a mechanical component having a complex shape is manufactured conventionally, in many cases, each of a plurality of components is first manufactured individually, and then, they are combined to obtain the shape of the product. In this case, parts having a complex shape such as a gear are often cut before being combined. On the other hand, in recent years, in order to reduce manufacturing costs, forming components having a shape similar to that of product by punching, hole expanding, forging, or the like is promoted. As a result, a number of the components can be reduced and manufacturing can be performed with fewer processes. When a large deformation is applied, a hot working in which deformation resistance is low is employed, and when it is necessary to work with good accuracy of shape, a cold working is employed. If the steel sheet is worked to be a complex shape similar to that of the product, the steel sheet needs a workability better than in the conventional case in which each of a plurality of parts is manufactured, and then, they are combined. That is, in a conventional steel sheet, if the steel sheet is punched, expanded, or forged so as to be a complex shape, the steel sheet may become cracked or the dimensional accuracy of the product may be deteriorated. In addition, of course, the product after working may require properties such as toughness, strength, wear resistance equal to or more than the conventional art. In order to solve the problems, Patent Documents 1 to 3 propose techniques as follows.

Patent Document 1 proposes a steel reclining seat gear of which a raw material is a steel sheet excellent in notched tensile elongation ratio, in which C: 0.15% to 0.50% and S: 0.01% or less in terms of mass %, and a relationship [% P]≤6×[% B]+0.005 is satisfied. Patent Document 1 focuses on a strong correlation between punchability and the notched tensile elongation ratio, and proposes that the notched tensile elongation ratio and the punchability can be enhanced by increasing a grain size of a carbide dispersed in the steel sheet.

Patent Document 2 proposes a high carbon steel which includes C: 0.70% to 1.20% in terms of mass %, and in which a grain size of carbide dispersed in ferrite matrix is controlled. Since the notched tensile elongation ratio of the steel, which has a close relationship with the punchability, is enhanced, the steel is excellent in punchability. In addition, since a configuration of MnS is controlled by further including Ca in the steel, the punchability of the steel is further enhanced.

Patent Document 3 proposes a steel for gear excellent in cold forgeability, which includes C: 0.10% to 0.40% and S: 0.010% or less in terms of mass %, in which shape of the inclusion is categorized in accordance with ASTM-D method, and in which the shape and the number of the inclusions are set within a range.

In addition, in order to control an amount and/or a configuration of inclusions in the steel, Ca and/or REM (Rare Earth Metal) has been added. The inventors have proposed a technique in which Ca and REM were added to a thick steel plate for structure including 0.08% to 0.22% of C in terms of mass % to control oxide (inclusion) formed in the steel as a mixture phase state of high-melting phase and low-melting phase for preventing the oxide (inclusion) from elongation during rolling and for preventing erosion of a continuous-casting nozzle and an internal inclusion defect from occurring.

PRIOR ART DOCUMENTS

Patent Documents

[Patent Document 1] Japanese unexamined patent application, First Publication No. 2000-265238

[Patent Document 2] Japanese unexamined patent application, First Publication No. 2000-265239

[Patent Document 3] Japanese unexamined patent application, First Publication No. 2001-329339

[Patent Document 4] Japanese unexamined patent application, First Publication No. 2011-68949

SUMMARY OF INVENTION

Technical Problem

The above-described four documents identify the cause of a starting point of cracking which deteriorates workability, specifically punchability and forgeability, and propose a countermeasure thereon. Patent Document 1 recognizes that micro voids grown from carbide is the starting point of cracking and intends to increase a grain size of the carbide to prevent the micro void from joining. Similar to that idea, Patent Document 2 proposes increasing a grain size of the carbide. In addition, Patent Document 2 focuses on that MnS in the steel sheet (elongated during rolling) acts as the starting point of cracking, and proposes including Ca to prevent MnS in the steel from forming. Patent Document 3 recognizes that an elongated oxide type inclusion (B-type of the ASTM-D method) and a non-elongated oxide type inclusion (D-type of ASTM-D method) cause deterioration of the forgeability, and defines the size, the length, and the total number thereof in accordance with the categorization of ASTM-D method.

However, in the above-described prior art, problems regarding workability and toughness of the product after working remain as follows.

In the steel described in Patent Document 1, although the punchability is enhanced by controlling the grain size of the carbide, the composition or configuration of the inclusions are not controlled, and thus, MnS elongated during rolling the steel remains in the steel. Therefore, cracking occurs in the steel during working under a severe working condition so as to be a more complex shape, in which the elongated MnS (which is categorized as an A-type inclusion, since the MnS is elongated in a working direction) acts as the starting point. Even if manufacturing is terminated without causing cracking, the elongated MnS remaining in the product deteriorates the toughness of the product after working.

In the steel described in Patent Document 2, including Ca causes spheroidizing of the shape of MnS, and thus, the number of the A-type inclusion decreases. On the other hand, the inventors found that, in the steel described in Patent Document 2, although A-type inclusions decreased, a granular inclusions discontinuously forming a line along with the working direction in a group (hereinafter B-type inclusions) and inclusions that are unevenly dispersed (hereinafter C-type inclusions) remain in the steel in a large number. In addition, it was found that the inclusions acted as the starting points of fractures which deteriorate the workability and the toughness of the product. Moreover, the steel described in Patent Document 2 includes Ti. However, there is a problem that, if a coarse carbonitride including Ti (categorized as C-type inclusion) forms independently in the steel, the carbonitride including Ti acts as the starting point of fracture, and thus, the workability and the toughness tend to deteriorate.

Although Patent Document 3 defines the size, the length, and the total number of the elongated oxide type inclusions and the non-elongated oxide type inclusions, Patent Document 3 discloses no specific method to archive the definition.

In Patent Document 4, the number density of the inclusions is controlled by adding Ca and/or REM. However, the amount of C of the steel described in Patent Document 4 is 0.08 mass % to 0.22 mass %, and thus, sufficient strength (tensile strength, wear resistance, hardness, and the like) may not be obtained if the steel is used as a raw material for machine structural component having a complex shape. Patent Document 4 does not disclose a method for controlling the number density of the inclusion in the steel for which it is necessary to include more than 0.25 mass % of C.

The present invention is invented in view of the above-described problem, and has an object to provide a carbon steel sheet including more than 0.25% and less than 0.50% of C in terms of mass % and having a workability suitable for manufacturing a product having a complex shape such as a gear.

Method for Solving the Problem

The present invention focuses on A-type inclusions, B-type inclusions, and C-type inclusions as the main starting points of fracture, deteriorating properties such as workability of the steel sheet, the toughness of the product, and the like. A steel sheet excellent in workability is provided by decreasing the amount of each of the A-type inclusions, the B-type inclusions, and the C-type inclusions. A product manufactured by the steel sheet according to the present invention, in which the number of the inclusions acting as the starting point of cracking is small, has high toughness. Therefore, reducing inclusions can enhance the workability of the steel sheet and the toughness of the product (manufactured with the steel using as raw material).

The gist of the invention is as follows.

(1) In a steel sheet according to one embodiment of the present invention, a chemical composition comprises, by mass %: C: more than 0.25% and less than 0.50%; Si: 0.10% to 0.60%; Mn: 0.40% to 0.90%; Al: 0.003% to 0.070%; Ca: 0.0005% to 0.0040%; REM: 0.0003% to 0.0050%; Cu: 0% to 0.05%; Nb: 0% to 0.05%; V: 0% to 0.05%; Mo: 0% to 0.05%; Ni: 0% to 0.05%; Cr: 0% to 0.50%; B: 0% to 0.0050%; P: limited to 0.020% or less; S: limited to 0.0070% or less; Ti: limited to 0.050% or less; O: limited to 0.0040% or less; N: limited to 0.0075% or less; and remainder including iron and impurity, amounts of each elements by mass % in the chemical composition satisfy both of expression 1 and expression 2, a number density of carbonitrides including Ti which exists independently and has a long side of 5 μm or more is limited to 5 pieces/mm$^2$ or less, $$0.3000 \leq \{Ca/40.88+(REM/140)/2\}/(S/32.07): \quad \text{expression 1,}$$

and $$Ca \leq 0.0058-0.0050 \times C: \quad \text{expression 2.}$$

(2) In the steel sheet according to the above-described (1), the chemical composition may further comprise one or more of, by mass %: Cu: 0.01% to 0.05%; Nb: 0.01% to 0.05%; V: 0.01% to 0.05%; Mo: 0.01% to 0.05%; Ni: 0.01% to 0.05%; Cr: 0.01% to 0.50%; and B: 0.0010% to 0.0050%.

(3) In the steel sheet according to the above-described (1) or (2), the steel sheet may further include a composite inclusion which includes Al, Ca, O, S, and REM, and an inclusion in which the carbonitride including Ti is adhered on the composite inclusion.

(4) In the steel sheet according to the above-described (1) or (2), the amounts of the each elements by mass % in the chemical composition may satisfy expression 3, $$18 \times (REM/140)-O/16 \geq 0: \quad \text{expression 3.}$$

(5) In the steel sheet according to the above-described (3), the amounts of the each elements by mass % in the chemical composition satisfy expression 4, $$18 \times (REM/140)-O/16 \geq 0: \quad \text{expression 4.}$$

Effect of the Invention

According to the above-described embodiments of the present invention, a steel sheet excellent in punchability, hole expansibility, forgeability, and the like and in toughness after working can be provided by reducing a number density of A-type inclusions, a number density of B-type inclusions, a number density of C-type inclusions, and a number density of coarse carbonitrides including Ti, which has angular shape and is present independently, in the steel.

EMBODIMENTS OF THE INVENTION

Figure 1:
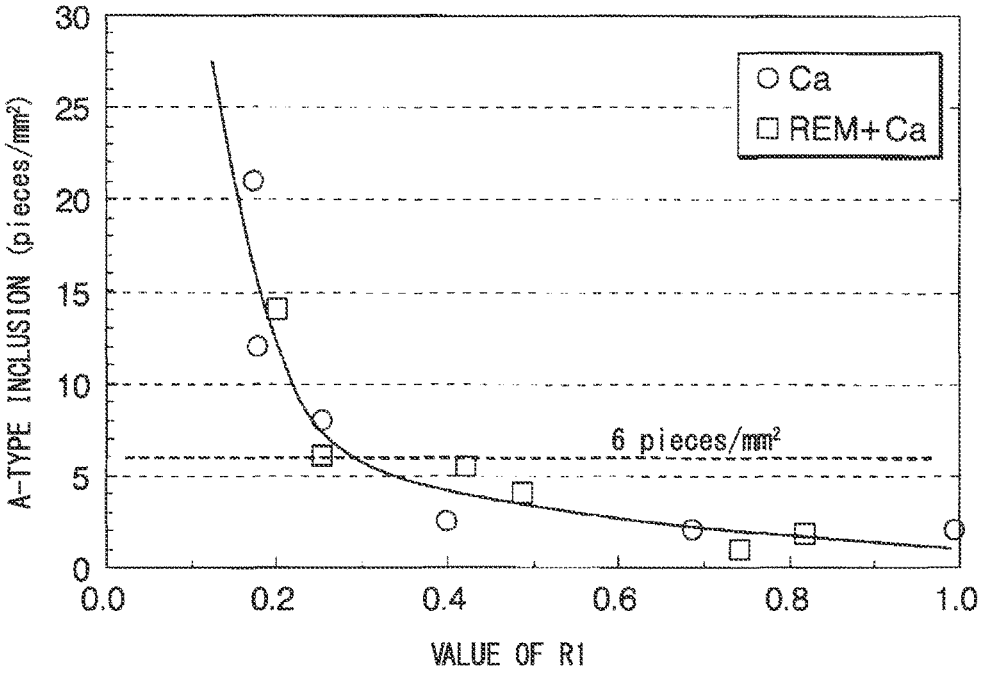
FIG. 1 A graph indicating a relationship between a total chemical equivalent of Ca and REM combining with S and number density of A-type inclusions.

Hereinafter, a preferable embodiment of the present invention will be described. However, the present invention is not limited to the construction disclosed in the present embodiment. Various modifications can be made on the present invention without departing from the spirit or scope of the present invention.

At first, inclusions included in the steel according to the present invention will be described.

Decreasing workability of the steel sheet is caused by non-metallic inclusions, carbonitrides, and the like. If stress is applied to the steel sheet, they act as starting points of cracking of the steel sheet. The inclusions are oxides, sulfides, or the like which exist in a molten metal or forms during solidification of the molten metal. The size of the inclusions (long side) is from several micrometers to several hundred micrometers if it is elongated by rolling. Therefore, in order to enhance the workability of the steel sheet, it is important to decrease the number of inclusions. As described above, a state in which the size as well as the number of the inclusions in the steel sheet is small, i.e. a state in which "cleanliness of the steel is high" is preferred.

Although the shape, the distribution state, and the like of the inclusions are various, in JIS G 0555, the inclusions are distinguished as A-type inclusions, B-type inclusions, and C-type inclusions. Hereinafter, in the present embodiment, inclusions are categorized as three types in accordance with the definition described below.

A-type inclusion: non-metallic inclusions in the steel, which are plastically deformed by working. It has high elongation and is frequently elongated along to a working direction in the worked steel sheet. In the present embodiment, inclusions of which an aspect ratio (size in long axis/size in short axis) is 3.0 or more are defined as the A-type inclusions.

B-type inclusion: non-metallic inclusions in the steel which are granular inclusions discontinuously forming a line along with the working direction in a group. It frequently has an angular shape and has low elongation. In the present embodiment, inclusions which form inclusion groups in which three or more of the inclusions form a line along to the working direction, in which clearance between the inclusions is 50 μm or less, and in which the aspect ratio (size in long axis/size in short axis) of the inclusions are less than 3.0 is defined as the B-type inclusion.

C-type inclusion: inclusions unevenly dispersing without plastic deformation. The C-type inclusions frequently have angular shapes or spheroidal shapes and have low elongation. In the present embodiment, inclusions of which an aspect ratio (size in long axis/size in short axis) is 3.0 or less, and which disperse in a random manner are defined as the C-type inclusion.

Although the carbonitride including Ti which is very hard and which has an angular shape is categorized by the C-type inclusions in general, the carbonitride including Ti may be distinguished from the C-type inclusions in the present embodiment. If the carbonitride including Ti exists independently, the influence of the carbonitride including Ti over the preference of the steel sheet is larger than that of the other C-type inclusions (C-type inclusions not being the carbonitride including Ti). "Carbonitride including Ti existing independently" is a carbonitride including Ti which exists in a state in which the carbonitride including Ti does not adhere to inclusions not including Ti. On the other hand, if the carbonitride including Ti exists in a state in which the carbonitride including Ti adheres to other inclusion (for example, composite inclusions including Al, Ca, O, S, and REM), the influence of the carbonitride including Ti over the preference of the steel sheet is substantially the same as that of the other C-type inclusions. In the present embodiment, the carbonitride including Ti adhering to the other inclusions is assumed as the C-type inclusions not being carbonitride including Ti.

In the present embodiment, "number density of C-type inclusions" is a total of "number density of the C-type inclusions which is not carbonitrides including Ti (including the carbonitrides including Ti adhering to the C-type inclusions)" and "number density of the carbonitrides including Ti existing independently". The carbonitrides including Ti can be distinguished from the other C-type inclusions based on the shape and the color thereof.

In the steel sheet according to the present embodiment, only inclusions having 1 μm or more of grain size (in a case of inclusions having substantially spheroidal shape) or 1 μm or more of size in long axis (in a case of deformed inclusions) are taken into account. Even if inclusions having a grain size or a size in long axis of less than 1 μm is included in the steel, the influence thereof over the workability of the steel is small, and therefore, such inclusions are not taken into account in the present embodiment. In addition, the long axis described above is defined as a longest line in lines connecting nonadjacent vertexes of outline form of cross section in the observed section of the inclusions. In a similar way, the size in short axis described above is defined as a shortest line in the lines connecting the nonadjacent vertexes of the outline form of the cross section in the observed section of the inclusions. In addition, a long side described below is defined as a longest line in lines connecting adjacent vertexes of the outline form of the cross section in the observed section of the inclusions. Hereinafter, "grain size (in a case of inclusions having substantially spheroidal shape) or size in long axis (in a case of deformed inclusions)" may be abbreviated as "grain size or size in long axis"

Conventionally, in order to control the number of inclusions in the steel and/or a configuration of the inclusions, Ca and/or REM (Rare Earth Metal) has been added therein. As described above, the inventors have proposed a technique in Patent Document 4, in which Ca and REM is added to a structural thick steel plate including 0.08% to 0.22% of C in terms of mass % to control oxides (inclusions) formed in the steel so as to be a mixed phase of a high-melting phase and a low-melting phase, and thus, the oxides (inclusions) is prevented from elongating during rolling and an erosion of a continuous-casting nozzle and an internal inclusion defect are prevented from occurring.

In addition, the inventors have studied a condition regarding a steel including more than 0.25% and less than 0.50% of C in terms of mass %, which could reduce the above-described A-type inclusions, B-type inclusions, and C-type inclusions by including Ca and REM. Consequently, a condition which could concurrently reduce the A-type inclusions, and the B-type inclusions and the C-type inclusions has been founded. The concrete content thereof is described as follows.

(Regarding A-Type Inclusion)

The inventors studied about further adding Ca and REM for the steel including more than 0.25% and less than 0.50% of C in terms of mass %. Consequently, it was found that when an amount of each elements in the chemical composition in terms of mass % satisfied below Expression I, the A-type inclusions in the steel, particularly MnS constructing the A-type inclusions, could be significantly reduced.

$$0.3000 \leq \{Ca/40.88+(REM/140)/2\}/(S/32.07): \quad \text{Expression I}$$

An experiment on which the finding was based is described as follows.

In a vacuum melting furnace, multiple types of steels including chemical compositions in which an amount of C was 0.45% in terms of mass % and the amounts of total O (T.O.), N, S, Ca, and REM were varied within ranges disclosed in Table 1 were manufactured as 50 kg ingots. These ingots were hot-rolled under a condition in which a finish rolling temperature was 860° C. and were air-cooled to obtain hot-rolled steels.

The inclusions in the hot-rolled steel sheets were observed by optical microscope at 400-fold magnification (if shapes of the inclusions were measured in detail, observed at 1000-fold magnification) in 60 view fields in total, in which observed sections were cross-sections parallel to rolling direction and plate thickness direction of the hot-rolled steel sheets. In each of the view fields, inclusions whose grain size were 1 μm or more (if a shape of the inclusions were spherical) or inclusions whose long axis were 1 μm or more (if shapes of the inclusions were deformed) were observed to categorize the inclusions as the A-type inclusions, the B-type inclusions and the C-type inclusions, and number densities thereof were measured. In addition, the number density of carbonitrides including Ti existing independently and having an angular shape, among the C-type inclusions, was measured. Moreover, the carbonitrides including Ti, composite inclusions including REM, MnS, Ca—$Al_2O_3$ type inclusions, and the like can be identified by observing structure of the hot-rolled steel sheet using EPMA (Electron Probe Micro Analysis) or SEM (Scanning Electron Microscope) having EDX (Energy Dispersive X-Ray Analysis).

Furthermore, as an index of workability of the hot-rolled steel sheets obtained as described above, a charpy impact value at room temperature (about 25° C.) was measured. The charpy impact value is a value indicating the toughness of the steel sheet. The more the inclusions there are, which act as a starting point of cracking or the larger the sizes of the inclusions are, the lower the charpy impact value is. Therefore, there is a strong correlation between the charpy impact value and the workability. When various works are performed, although a value of a limit strain which causes cracking varies depending on each methods of the working, the value of a limit strain has a correlation with the charpy impact value.

The results of the above-described experiment showed that there was a correlation between the charpy impact value and the number density of the inclusions. Specifically, it became clear that if a number density of the A-type inclusions in the steel was more than 6 pieces/$mm^2$, the charpy impact value was greatly deteriorated. In addition, it became clear that more than 6 pieces/$mm^2$ of a total number density of the B-type inclusions and the C-type inclusions violently deteriorated the charpy impact value. Furthermore, regarding the carbonitrides including Ti which are the C-type inclusions, it became clear that if a number density of the coarse carbonitrides including Ti, which existed independently and which had 5 μm or more of long side, was more than 5 pieces/$mm^2$, the charpy impact value was greatly deteriorated.

[Table 1]

Next, the inventors studied a specific method for archiving the number density of the inclusions as described above.

In steel, it is assumed that Ca combines with S to form CaS, and REM combines with S and O to form $REM_2O_2S$ (oxysulfide). R1, which is a total chemical equivalent of Ca and REM combining with S, can be expressed as $$R1=\{Ca/40.88+(REM/140)/2\}/(S/32.07)$$

in which an atomic weight of S is assumed as 32.07, an atomic weight of Ca is assumed as 40.88, an atomic weight of REM is assumed as 140, and an amount of each elements in a chemical composition in terms of mass % is used.

Thus, a relationship between the number densities of the A-type inclusions measured in the above-described hot-rolled steel sheets and the above-described R1 of the each hot-rolled steels was examined. The results are shown in FIG. 1. In the FIG. 1, a circular symbol represents a result of a steel including a chemical composition which includes Ca and does not include REM (hereinafter, referred as "single incorporation of Ca") and a quadrangular symbol (described as "REM+Ca" in the FIG. 1) represents a result of a steel including a chemical composition which includes both of Ca and REM (hereinafter, referred as "compositely incorporation of REM and Ca"). In a case of the single incorporation of Ca, the amount of REM was assumed as 0 to calculate the above-described R1. From the FIG. 1, it became clear that in both case of the single incorporation of Ca and the compositely incorporation of REM and Ca, there was a correlation between the number density of the A-type inclusions and the above-described R1.

Specifically, when the value of the above-described R1 is 0.3000 or more, the number density of the A-type inclusions decreases to be 6 pieces/$mm^2$ or less. Consequently, a charpy impact value enhances.

A size in long axis of the A-type inclusion in the steel in the case of the single incorporation of Ca is longer than that in the case of the compositely incorporation of REM and Ca. It is assumed that, in the case of the single incorporation of Ca, CaO—$Al_2O_3$ type low-melting oxide forms as the A-type inclusion and the oxide is elongated during rolling. Therefore, in view of the size in long axis of the inclusions which has an adverse effect on characteristics of the steel sheet, the compositely incorporation of REM and Ca is more desirable than the single incorporation of Ca.

Consequently, it was found that, when the above-described expression I was satisfied and the REM and Ca were compositely included, the number density of the A-type inclusions in the steel preferably decreased to 6 pieces/$mm^2$ or less.

When the value of R1 is 1.000, as an average composition, 1 equivalence of Ca and REM combining with S in the steel are exist in the steel. However, in practice, even if the value of R1 is 1.000, MnS may form at micro segregation portion between dendrite branches. When the value of R1 is 2.000 or more, forming MnS at the micro segregation portion between the dendrite branches can be preferably prevented from causing. On the other hand, if a large amount of Ca and REM are included and the value of R1 is more than 5.000, coarse B-type inclusions or coarse C-type inclusions having more than 20 μm of maximum length tend to form. Therefore, it is preferable that the value of R1 is 5.000 or less. That is, it is preferable that an upper limit of the right side of the above-described expression I is 5.000.

(Regarding B-Type Inclusion and C-Type Inclusion)

As described above, the number density of the B-type inclusions and C-type inclusions having less than 3 of the aspect ratio (size in long axis/size in short axis) and having 1 μm or more of the grain size or the size in long axis was measured by observing the above-described observing surface of the hot-rolled steel sheet. As a result, the inventors found that, in both cases of the single incorporation of Ca and the compositely incorporation of REM and Ca, the greater the amount of Ca was, the larger the number density of the B-type inclusions and C-type inclusions was. On the other hand, the inventors found that the amount of REM did not strongly effect on the number density of the inclusions.

Figure 2:
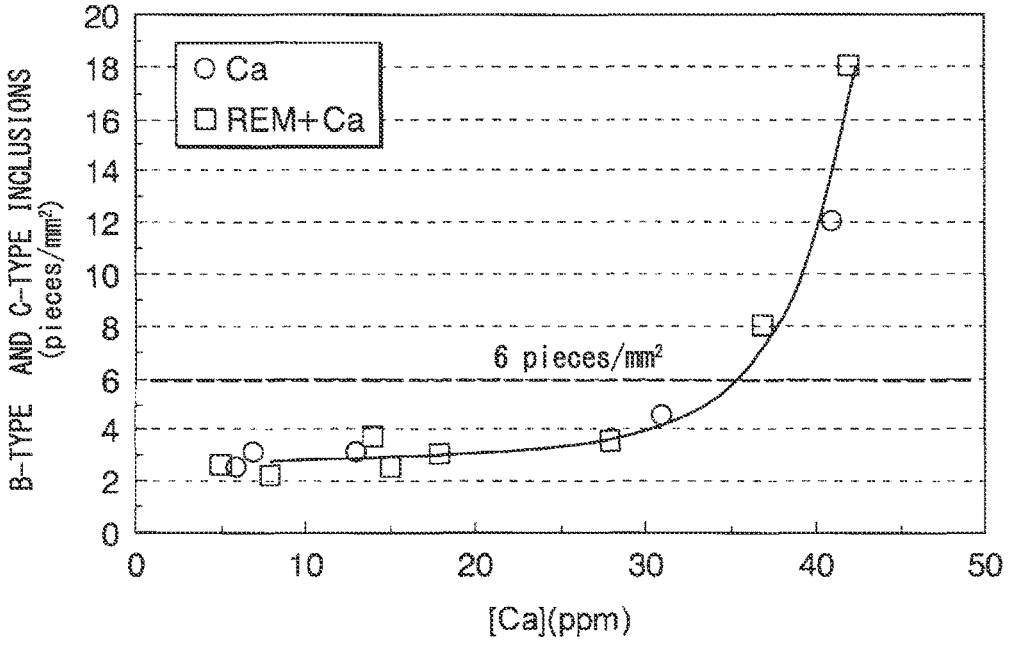
FIG. 2 A graph indicating a relationship between an amount of Ca in a steel and the total number density of B-type inclusions and C-type inclusions.

FIG. 2 shows a relationship between the amount of Ca in the steel and the total number density of the B-type inclusions and the C-type inclusions in both cases of the single incorporation of Ca and the compositely incorporation of REM and Ca. In the FIG. 2, the circular symbol shows the result in the single incorporation of Ca, and the quadrangular symbol (which is illustrated as "REM+Ca" in the FIG. 2) shows the result in the compositely incorporation of REM and Ca. From the FIG. 2, it became clear that, in both cases of the single incorporation of Ca and the compositely incorporation of REM and Ca, the greater the amount of Ca in the steel was, the greater the total number density of the B-type inclusions and the C-type inclusions was. In addition, when the amount of Ca in the case of the single incorporation of Ca and the amount of Ca in the case of the compositely incorporation of REM and Ca were equal, the total number densities of the B-type inclusions and the C-type inclusions thereof were substantially equal. That is, it was found that, if REM and Ca were compositely included in the steel, REM did not affect the total number density of the B-type inclusions and the C-type inclusions.

As described above, in order to decrease the A-type inclusions, it is preferable to increase the amount of Ca and the amount of REM in the steel within the above-described range. On the other hand, if the amount of Ca is increased to reduce the A-type inclusions, as described above, a problem of increasing the B-type inclusions and the C-type inclusions is caused. That is, in the case of the single incorporation of Ca, it is not possible to concurrently reduce the A-type inclusions, and the B-type inclusions and the C-type inclusions. On the other hand, in the case of the compositely incorporation of REM and Ca, the amount of Ca can be reduced while the chemical equivalent (the value of R1) of REM and Ca combining with S is secured, and thus, the case is preferable. That is, it was found that, in the case of the compositely incorporation of REM and Ca, the number density of the A-type inclusions could be preferably decreased without increasing the total number density of the B-type inclusions and the C-type inclusions.

It is assumed that the reason why the total number density of the B-type inclusions and the C-type inclusions depends on the amount of Ca is as follows.

As described above, in the case of the single incorporation of Ca, Ca—$Al_2O_3$ type inclusions form in the steel. The inclusions are low-melting oxides, and thus the inclusions are liquid phase in molten steel and tend not to aggregate and unite in the molten steel. That is, it is difficult to flotation-separate the Ca—$Al_2O_3$ type inclusions from the molten steel. Therefore, a large amount of the inclusions having a size of several micrometers disperse and remain in the slab, and thus, the total number density of the B-type inclusions and the C-type inclusions increases.

In addition, as described above, in the case of the compositely incorporation of REM and Ca, the total number density of the B-type inclusions and the C-type inclusions increases depend on the amount of Ca in a same manner. A melting point of an inclusion, of which REM content is large, is higher than the melting point of the Ca—$Al_2O_3$ type inclusion, and the inclusion having a REM content is large exists as solid state in the molten steel. However, in the case of the compositely incorporation of REM and Ca, a inclusion of which Ca content is large forms around the inclusion of which REM content is large, in which the inclusion of which REM content is large acts as a core. The inclusion is called Ca-REM composite inclusion. In this case, the inclusion of which Ca content is large is liquid phase in the molten steel. That is, a surface of the Ca-REM composite inclusion is liquid phase in the molten steel, and it is assumed that a behavior of aggregation and union thereof is similar to that of the Ca—$Al_2O_3$ type inclusion which forms in the case of the single incorporation of Ca. Therefore, it is assumed that a large amount of the Ca-REM composite inclusions disperse and remain in the slab, and the total number density of the B-type inclusions and the C-type inclusions increases.

The Ca—$Al_2O_3$ type inclusion is elongated by rolling to be the A-type inclusion if the grain size or the size in the long axis thereof is more than about 4 μm. On the other hand, if the grain size or the size in long axis of the Ca—$Al_2O_3$ type inclusion is less than about 4 μm, the Ca—$Al_2O_3$ type inclusion is hardly elongated (ratio of size in long axis/size in short axis thereof remains to less than 3) by the rolling, and thus, the Ca—$Al_2O_3$ type inclusion becomes the B-type inclusion or the C-type inclusion after the rolling. In addition, the inclusion of which REM content is large, which forms in the case of the compositely incorporation of REM and Ca, is hardly elongated by the rolling. Furthermore, the inclusion having large Ca content, which forms around the inclusion having large REM, is also hardly elongated through the rolling. That is, in the case of the compositely incorporation of REM and Ca, the inclusion of which REM content is large prevents the inclusion of which Ca content is large from elongation, and thus, inclusions become mainly the B-type inclusions and the C-type inclusions.

Moreover, the inventors found that the number density of the B-type inclusions and the C-type inclusions was affected by an amount of C in the steel. Hereinafter, the effect of the amount of C in the steel is described.

Ingots including 0.26% of C in terms of mass % were manufactured and the number density of the B-type inclusions and the C-type inclusions thereof was measured by the experiment of which the method is same to the above-described method. Then, an experimental result of the steel including 0.26% of C and an experimental result of the above-described steel including 0.45% of C were compared.

As a result of the comparison, it became clear that the total number density of the B-type inclusions and the C-type inclusions related to the amount of Ca and the amount of C. Specifically, the inventors found that, even if the amount of Ca was the same, the greater the amount of C was, the more the total number density of the B-type inclusions and the C-type inclusions was. More specifically, it was found that, in order to reduce the total number density of the B-type inclusions and the C-type inclusions to 6 pieces/$mm^2$ or less, it was necessary that the amounts of each elements in terms of mass % in the chemical composition were controlled within a range expressed by the follow expression II.

$$Ca \leq 0.0058 - 0.0050 \times C: \qquad \text{Expression II}$$

The expression II indicates that it is necessary to vary an upper limit of the amount of Ca depending on the amount of C, i.e. it is necessary that the more the amount of C is, the lower the upper limit of the amount of Ca is. Although the lower limit of the right side of the above-described expression II is not limited, the substantial lower limit of the right side of the above-described expression II is 0.0005, which is the lower limit of the amount of Ca in terms of mass %.

It is assumed that the reason why increasing the amount of C increases the total number density of the B-type inclusions and the C-type inclusions is that increasing the C concentration in the molten steel extends the range of solidification temperature, which is from liquidus temperature to solidus temperature, to increase the length of the dendrite structure. That is, it is assumed that since the dendrite structure grows long, inclusions are easily captured between the dendrite branches (inclusions are hardly effused from between the dendrite branches). Therefore, there is a tendency that the more the amount of C in the steel, the longer the dendrite structure during solidification grows, and thus, in order to satisfy the above-described expression II, it is necessary that the more the amount of C in the steel, the lower the upper limit of the amount of Ca is.

The phase of the steel having the above-described carbon concentration range (C: more than 0.25% and less than 0.50%) during solidification is liquid phase+δ phase at peritectic temperature or more and is liquid phase+γ phase at the peritectic temperature or lower. That is, a degree of microsegregation of solute element such as S at the peritectic temperature or lower differs from that at the peritectic temperature or higher. It should be noted that S has an effect on capturing inclusions since S is a surface-active element, and that a solid/liquid distribution coefficient of S in a case where the phase is liquid phase+γ phase is lower than that of S in a case where the phase is liquid phase+δ phase. The lower the solid/liquid distribution coefficient of S is, the less an amount of S distributed to the solid phase is and the more an amount of S distributed to the liquid phase is. When a large amount of S which is the surface-active element is distributed to the liquid phase, an interface energy between the liquid phase and the solid phase decreases, and thus, the inclusions become to be easily captured by the interface between the liquid phase and the solid phase.

When a temperature of the steel is the peritectic temperature or lower (i.e. a phase of the steel is liquid phase+γ phase), S is distributed to the liquid phase in comparatively large content. Thus, the degree of microsegregation of S between the dendrite branches (γ phase) becomes high. Therefore, it is assumed that the inclusions are easily captured in particular at the peritectic temperature or lower. In addition, the higher the C concentration is, the easier the inclusions are captured between the dendrite branches, since the higher the C concentration is, the less the δ phase is and the more the γ phase is. The expression II was defined based on the evaluation including the above-described effect and on the observing result. When the C concentration in the steel is more than 0.25% and less than 0.50% which is higher than the peritectic point, the expression II is valid.

As described above, it was found that both the A-type inclusions, and the B-type inclusions and the C-type inclusions can be advantageously decreased by including a proper amount of REM and Ca depending of the amount of C. In addition to these findings, the inventors studied about a configuration of the carbonitrides including Ti which easily became to a starting point of cracking.

(Regarding Carbonitride Including Ti)

If Ti is mixed from auxiliary raw material such as alloy, scrap, and the like, the carbonitride including Ti such as TiN forms in the steel. The carbonitride including Ti has high hardness and has an angular shape. Therefore, if the coarse carbonitride including Ti independently forms in the steel, the charpy impact energy of the steel and then the workability of the steel are deteriorated, since the carbonitride tends to act as the starting point of fracture.

As described above, a relationship between an amount of the carbonitride including Ti and the workability of the steel sheet was studied, and as a result, it was found that if the number density of the carbonitrides including Ti existing independently and having 5 μm or more of the long side was 5 pieces/mm$^2$ or less, fracture hardly occurred and the workability was prevented from deterioration. Here, the carbonitride including Ti includes Ti carbide, Ti nitride and Ti carbonitride. In addition, if Nb which is optionally element is included, the carbonitride including Ti includes TiNb carbide, TiNb nitride and TiNb carbonitride, and the like.

In order to decrease such coarse carbonitride including Ti, it is considered to decrease an amount of Ti. However, in a range of C concentration of the steel according to the present embodiment, the carbonitride including Ti easily forms even if the amount of Ti is extremely small and the carbonitride including Ti, which is once formed, easily coarsen during heat treatment of the steel. Therefore, if the C concentration is more than 0.25% and less than 0.50%, the number density of the carbonitrides including Ti may be increased to more than 5 pieces/mm$^2$ due to Ti mixed as impurity to deteriorate the workability of the steel, even if Ti is not included as a composition of the steel. As a method for solving the problem, it is considered to prevent Ti from being mixed during manufacturing stage to control the amount of Ti to about 10 ppm. However, in view of equipment capacity and manufacturing efficiency, it is not preferable to employ such a method.

Therefore, the inventors studied another method for reducing the adverse effect due to such coarse carbonitrides including Ti, and thus, the inventors found that the compositely incorporation of REM and Ca is effective.

When REM and Ca are compositely included, at first, composite inclusions including Al, Ca, O, S, and REM form in the steel, and then, the carbonitrides including Ti compositely and preferentially form on the composite inclusions including REM. By compositely and preferentially forming the carbonitrides including Ti on the composite inclusions including REM, the carbonitrides including Ti which form independently in the steel and which have angular shape can be reduced. That is, the number density of the coarse carbonitrides including Ti existing independently and having 5 μm or more of long side can be preferably reduced to 5 pieces/mm$^2$ or less.

The carbonitrides including Ti which compositely form on the composite inclusions including REM hardly act as starting points of fracture. Regarding the reason for this, it is assumed that angular shape portions of the carbonitrides including Ti are reduced by compositely precipitating the carbonitrides including Ti on the composite inclusions including REM. For example, the shape of the carbonitride including Ti is cubic or rectangular parallelepiped, and thus, if the carbonitride including Ti exists independently in the steel, all of 8 points of vertexes of the carbonitride including Ti contact with matrix. The vertex acts as the starting point of fracture, and thus, the carbonitride including Ti, which has 8 points of vertexes, has 8 points of starting points of fracture. On the other hand, for example, if the carbonitride including Ti compositely precipitates on the composite inclusion including REM and half of the shape of the carbonitride including Ti contacts with the matrix, only 4 points of the carbonitride including Ti contact with the matrix. That is, the vertexes of the carbonitride including Ti contacting with the matrix are reduced from 8 points to 4 points. As a result, the starting points of fracture due to the carbonitride including Ti are reduced from 8 points to 4 points.

In addition, in consideration that the carbonitride including Ti precipitates on specific crystal face of the composite inclusion including REM, it is assumed that the reason why the carbonitride including Ti tends to compositely and preferentially precipitates on the composite inclusion including REM is that lattice consistency between the specific crystal face of the composite inclusion including REM and the carbonitride including Ti is good.

An adverse effect of the composite of the carbonitride including Ti and the inclusion including REM (i.e. the inclusion in which the carbonitride including Ti adheres on the surface of the composite inclusion including Al, Ca, O, S, and REM) is smaller than that of the carbonitride including Ti existing independently, and thus, it is recognized that the composite of the carbonitride including Ti and the inclusion including REM is not the carbonitride including Ti existing independently and is the C-type inclusion.

Next, a chemical composition of the steel sheet according to the present embodiment will be described.

At first, a limited range and a reason of the limitation regarding a basic composition of the steel sheet according to the present embodiment will be described. The term "%" described herein is "mass %".

(C: More than 0.25% and Less than 0.50%)

C (carbon) is an important element for securing strength (hardness) of the steel sheet. The strength of the steel sheet is secured by setting the amount of C to more than 0.25%. When the amount of C is 0.25% or less, hardenability of the steel sheet decreases, and thus, strength which is necessary for products made by using the steel sheet as a material, for example gears and the like, cannot be obtained. On the other hand, if the amount of C is 0.50% or more, since long time is required for heat treatment for securing workability, the workability of the steel sheet may be deteriorated unless otherwise the time for the heat treatment is elongated. In addition, if the amount of C increases, the total number density of the B-type inclusions and the C-type inclusions increases. It is assumed that the reason of this is that, if the amount of C is high, the dendrite structure grows long during solidification of the molten steel, and thus, the inclusions are easily captured between the dendrite branches. Therefore, the amount of C is controlled to more than 0.25% and less than 0.50%.

Figure 3:
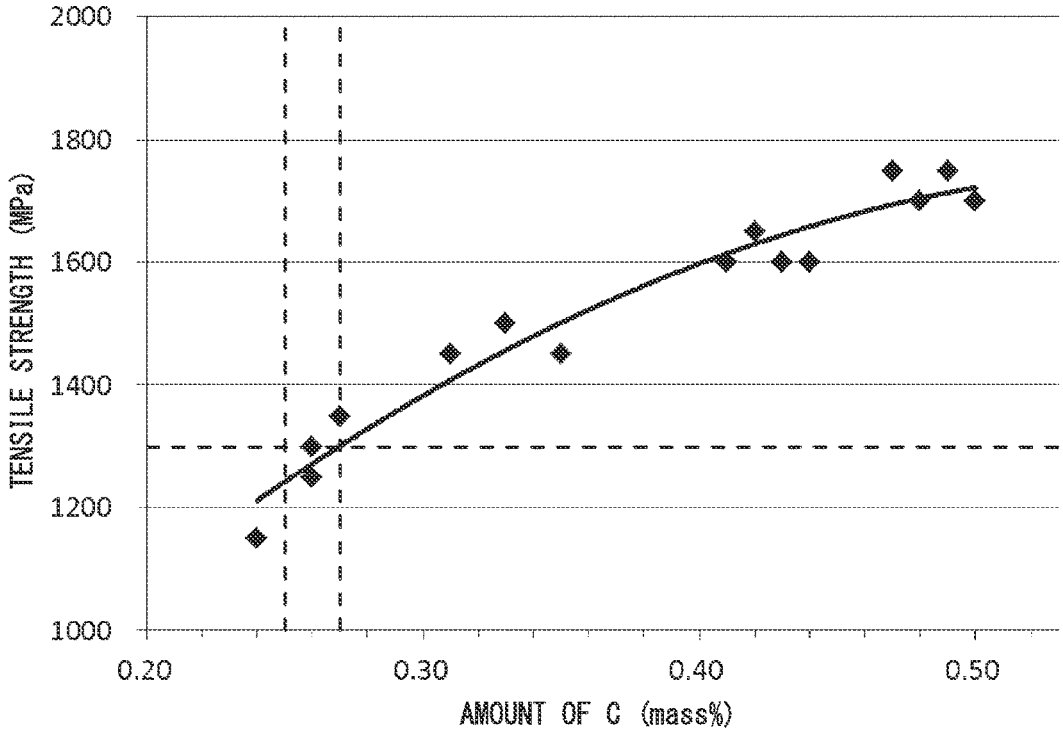
FIG. 3 A graph indicating a relationship between an amount of C in a steel and tensile strength of the steel.

It is preferable that the lower limit of C is 0.27%. Generally, the higher the amount of C is, the higher the hardness and the tensile strength after performing heat treatments (quenching and tempering) increase. Specifically, when the amount of C is 0.27% or more, 1300 MPa or more of strength can be sufficiently secured after performing the quenching and the low-temperature tempering. FIG. 3 is a graph showing a relationship between the amount of C and the tensile strength. The inventors measured the tensile strength of the steel sheets which satisfied the condition of the steel sheet according to the present embodiment except for the amount of C, and which had various amount of C. As a result, it was found that, when the amount of C was 0.27% or more, the steel certainly had 1300 MPa or more of tensile strength. In addition, in the steel sheet according to the present embodiment, it is preferable that the lower limit of the amount of C be 0.30%. In the steel sheet according to the present embodiment, it is preferable that the upper limit of the amount of C is 0.48%.

(Si: 0.10% to 0.60%)

Si (silicon) acts as a deoxidizing agent, and Si is an element effective for increasing hardenability to enhance the strength (hardness) of the steel sheet. If the amount of Si is less than 0.10%, the above-described effect cannot be obtained. On the other hand, if the amount of Si is more than 0.60%, a deterioration of surface property of the steel sheet due to a scale flaw during hot rolling may be caused. Therefore, the amount of Si is controlled to be 0.10% to 0.60%. It is preferable that the lower limit of the amount of Si is 0.15%. It is preferable that the upper limit of the amount of Si is 0.55%.

(Mn: 0.40% to 0.90%)

Mn (manganese) is an element which acts as a deoxidizing agent and an element effective for increasing hardenability to enhance the strength (hardness) of the steel sheet. If the amount of Mn is less than 0.40%, the above-described effect cannot be obtained sufficiently. On the other hand, if the amount of Mn is more than 0.90%, the workability of the steel sheet may deteriorate. Therefore, the amount of Mn is controlled to 0.40% to 0.90%. It is preferable that the lower limit of Mn is 0.50%. It is preferable that the upper limit of Mn is 0.75%.

(Al: 0.003% to 0.070%)

Al (aluminum) is an element which acts as a deoxidizing agent and an element effective for fixing N to enhance the workability of the steel sheet. If the amount of Al is less than 0.003%, the above-described effect cannot be obtained sufficiently, and thus, it is necessary that 0.003% or more of Al is included. On the other hand, if the amount of Al is more than 0.070%, the above-described effect saturates and coarse inclusions increase. The workability may be deteriorated by the coarse inclusions, or the surface flaw may tend to be easily occurred by the coarse inclusions. Therefore, the amount of Al is controlled to be 0.003% to 0.070%. It is preferable that the lower limit of Al is 0.010%. It is preferable that the upper limit of Al be 0.040%.

(Ca: 0.0005% to 0.0040%)

Ca (calcium) is an element effective for controlling configuration of the inclusions to enhance the workability of the steel sheet. If the amount of Ca is less than 0.0005%, the above-described effect cannot be obtained sufficiently. Although REM can control the configuration of the inclusions, if the amount of Ca is less than 0.0005%, nozzle clogging may occur during continuous casting to prevent the operation from stable and inclusions having large specific gravity may accumulate at lower surface side of the slab to deteriorate the workability of the steel sheet, in a same manner as a case of the single incorporation of REM described as follows. On the other hand, if the amount of Ca is more than 0.0040%, coarse low-melting oxides such as, for example, $CaO—Al_2O_3$ type inclusions and/or inclusions such as CaS type inclusion which easily elongate during rolling may easily form to deteriorate the workability of the steel sheet. In addition, if the amount of Ca is more than 0.0040%, nozzle refractor erosion may easily occur and deteriorate stability of the operation of the continuous casting. Therefore, the amount of Ca is controlled to 0.0005% to 0.0040%. A lower limit of the amount of Ca is preferably 0.0007% and more preferably 0.0010%. An upper limit of the amount of C is preferably 0.0030% and more preferably 0.0025%.

Moreover, it is necessary that the upper limit of the amount of Ca is controlled depending on the amount of C. Specifically, it is necessary that the amount of C and the amount of Ca in terms of mass % in the chemical composition are controlled within a range expressed by the below expression III. If the amount of Ca does not satisfy the below expression III, the total number density of the B-type inclusions and the C-type inclusions becomes more than 5 pieces/$mm^2$.

$$Ca \leq 0.0058 - 0.0050 \times C: \qquad \text{Expression III}$$

(REM: 0.0003% to 0.0050%)

REM (Rare Earth Metal) indicates rare earth elements and is a generic name for 17 elements consisting of scandium Sc (atomic number 21), yttrium Y (atomic number 39), and lanthanoid (15 elements from lanthanum of which atomic number is 57 to lutetium of which atomic number is 71). The steel sheet according to the present embodiment includes one or more elements selected from the 17 elements. Generally, in view of availability, REM is often selected from Ce (cerium), La (lanthanum), Nd (neodymium), and Pr (praseodymium). Adding misch metal which is a mixture of these elements into the steel is extensively used. A main composition of the misch metal is Ce, La, Nd, and Pr. In the steel sheet according to the present embodiment, a total amount of these rare earth elements included in the steel sheet is recognized as the amount of REM. In the above-described method for calculating R1 which is a total chemical equivalent of Ca and REM, since an average atomic weight of the misch metal is about 140, it is recognized that the atomic weight of REM is 140.

REM is an element effective for controlling the configuration of the inclusions to enhance the workability of the steel sheet. If the amount of REM is less than 0.0003%, the above-described effect cannot be obtained sufficiently, and a problem which is the same as the case of the single incorporation of Ca occurs. That is, if the amount of REM is less than 0.0003%, CaO—$Al_2O_3$ type inclusions and part of CaS may be elongated by rolling to deteriorate the property of the steel sheet (workability and toughness after working). In addition, if the amount of REM is less than 0.0003%, the composite inclusions including Al, Ca, O, S, and REM, on which the carbonitrides including Ti tend to preferentially composite, are low, and thus, the carbonitrides including Ti which form independently in the steel sheet increase to easily deteriorate the workability. On the other hand, if the amount of REM is more than 0.0050%, nozzle clogging tends to occur during continuous casting. In addition, if the amount of REM is more than 0.0050%, the number density of the formed REM-type inclusions (oxides, or oxysulfides) becomes comparatively high, and thus, the REM-type inclusions accumulate at lower surface side of the slab curbed during continuous casting the slab. This causes an internal defect in the product obtained by rolling the slab, and this may deteriorate the workability of the steel sheet. Therefore, the amount of REM is controlled to 0.0003% to 0.0050%. The lower limit of the amount of REM is preferably 0.0005%, and more preferably 0.0010%. The upper limit of the amount of REM is preferably 0.0040% and more preferably 0.0030%.

Moreover, it is necessary that the amount of Ca and the amount of REM are controlled depending on the amount of S. Specifically, it is necessary that the amount of each elements in the chemical composition in terms of mass % are controlled within a range expressed by the below expression IV. If the amount of Ca, the amount of REM, and the amount of S do not satisfy the below expression IV, the number density of the A-type inclusions becomes more than 6 pieces/$mm^2$. When the value of the right side of the below expression IV is 2 or more, the configuration of the inclusions can be controlled more preferably. Furthermore, although the upper limit of the below expression IV is not limited, if the value of the right side of the below expression IV is more than 5, the coarse B-type inclusions or the coarse C-type inclusions having more than 20 μm of maximum length tend to occur. Therefore, it is preferable that the upper limit of the below expression IV is 5.

$$0.3000 \leq \{Ca/40.88+(REM/140)/2\}/(S/32.07): \quad \text{Expression IV}$$

In addition to the above-described basic composition, the steel sheet according to the present embodiment includes impurity. The impurity indicates elements of P, S, Ti, O, N, Cd, Zn, Sb, W, Mg, Zr, As, Co, Sn, Pb, and the like mixed from auxiliary raw material such as scrap or from manufacturing process. Since it is not essential to include these elements, the lower limit of the amount of these elements is 0%. Among them, P, S, Ti, O, and N is limited as follows in order to preferably exercise the above-described effect. In addition, it is preferable that the above-described impurity except for P, S, O, Ti, and N are limited to 0.01% or less. However, if 0.01% or more of these impurities are included, the above-described effect is not lost. The term "%" described herein is "mass %".

(P: 0.020% or Less)

P (phosphorus) has an activity of solute strengthening. On the other hand, excess amount of P deteriorate the workability of the steel sheet. Therefore, the amount of P is limited to 0.020% or less. The lower limit of P may be 0%. In view of the conventional refining (including second refining), the lower limit of P may be 0.005%.

(S: 0.0070% or Less)

S (sulfur) is an impurity element which forms nonmetallic inclusion to deteriorate the workability of the steel sheet. Therefore, the amount of S is limited to 0.0070% or less, and preferably limited to 0.0050% or less. The lower limit of the amount of S may be 0%. In view of the conventional refining (including second refining), the lower limit of S may be 0.0003%.

(Ti: 0.050% or Less)

Ti (titanium) is an element which forms the carbonitrides, which is hard and has angular shape, to deteriorate the workability of the steel sheet. In the present embodiment, although the harmful effect thereof on the workability can be relieved by preferentially precipitating on the inclusions including REM as described above, if the amount of Ti is more than 0.050%, the deterioration of the workability become obvious. Therefore, the amount of Ti is limited to 0.050% or less. The lower limit of the amount of Ti may be 0%. In view of the conventional refining (including second refining), the lower limit of Ti may be 0.0005%.

(O: 0.0040% or Less)

O (oxygen) is an impurity element forming oxides (nonmetallic inclusions), which aggregate and coarsen to deteriorate the workability of the steel sheet. Therefore, the amount of O is limited to 0.0040% or less. The lower limit of the amount of O may be 0%. In view of the conventional refining (including second refining), the lower limit of O may be 0.0010%. The amount of O of the steel sheet according to the present embodiment indicates a total amount of O (amount of T.O) which is a total of the amount of all O such as solid-solute O in the steel, O existing in the inclusions, and the like.

In addition, it is preferable that the amount of O and the amount of REM in terms of mass % of each elements are controlled within the range expressed by the below expression V. When the following expression V is satisfied, the number density of the A-type inclusions further decreases, and thus, it is preferable. Although the upper limit of the below expression V is not limited, the upper limit of the left side of the below expression V is substantially 0.000643 in view of the upper limit and the lower limit of the amount of O and the amount of REM.

$$18 \times (REM/140) - O/16 \geq 0 \quad \text{Expression V}$$

When the amount of O and the amount of REM is controlled based on the expression V to form mixed configuration of two kinds of composite oxides of $REM_2O_3.11Al_2O_3$ (in which molar ratio of $REM_2O_3$ and $Al_2O_3$ is 1:11) and $REM_2O_3.Al_2O_3$ (in which molar ratio of $REM_2O_3$ and $Al_2O_3$ is 1:1), the A-type inclusions more preferably decrease. In the above expression V, "REM/140" expresses number of moles of REM and "O/16" expresses number of moles of O. In order to form the mixed configuration of $REM_2O_3.11Al_2O_3$ and $REM_2O_3.Al_2O_3$, it is preferable that REM is included with the amount thereof satisfying the above expression V. If the amount of REM is low such that the above expression V is not satisfied, mixed configuration of $Al_2O_3$ and $REM_2O_3.11Al_2O_3$ may form. $Al_2O_3$ part included in the mixed configuration and CaO may react to form CaO—$Al_2O_3$ type inclusions which may be elongated by rolling.

(N: 0.0075% or Less)

N (nitrogen) is an impurity element forming nitride (nonmetallic inclusion) to deteriorate the workability of the steel sheet. Therefore, the amount of N is limited to 0.0075% or less. The lower limit of the amount of N may be 0%. In view of conventional refining (including second refining), the lower limit of N may be 0.0010%.

In the steel sheet according to the present embodiment, the above-described basic compositions are controlled and a remainder includes iron and above-described impurity. On the other hand, in addition to the basic compositions, the steel sheet according to the present embodiment may further include follow optional compositions in the steel in place of the part of the iron in the remainder, as necessary.

That is, in addition to the above-described basic compositions and the impurity, the hot-rolled steel sheet according to the present embodiment may further include one or more of Cu, Nb, V, Mo, Ni, and B as optional compositions. Hereinafter, a limited range and a reason of the limitation regarding optional compositions will be described. The term "%" described herein is "mass %".

(Cu: 0.05% or Less)

Cu (copper) is an optional element having an effect of enhancing strength (hardness) of the steel sheet. Therefore, as necessary, Cu may be included within a range of 0.05% or less. In addition, when the lower limit of the amount of Cu is 0.01%, the above-described effect can be obtained preferably. On the other hand, if the amount of Cu is more than 0.05%, hot working cracking may occur during hot rolling due to molten metal embrittlement (Cu cracking). A preferable range of the amount of Cu is 0.02% to 0.04%.

(Nb: 0.05% or Less)

Nb (niobium) is an optional element which forms carbonitrides and is effective for preventing grain from coarsening and for enhancing the workability of the steel sheet. Therefore, as necessary, Nb may be included within a range of 0.05% or less. In addition, when the lower limit of the amount of Nb is 0.01%, the above-described effect can be obtained preferably. On the other hand, if the amount of Nb is more than 0.05%, coarse Nb carbonitrides may precipitate to deteriorate the workability of the steel sheet. A preferable range of the amount of Nb is 0.02% to 0.04%.

(V: 0.05% or Less)

V (vanadium) is an optional element which forms carbonitrides similar to Nb and is effective for preventing grains from coarsening and for enhancing the workability of the steel sheet. Therefore, as necessary, V may be included within a range of 0.05% or less. In addition, when the lower limit of the amount of V is 0.01%, the above-described effect can be obtained preferably. On the other hand, if the amount of V is more than 0.05%, coarse inclusions may form to deteriorate the workability of the steel sheet. A preferable range of the amount is 0.02% to 0.04%.

(Mo: 0.05% or Less)

Mo (molybdenum) is an optional element which has an effect of enhancing hardenability and enhancing resistance to temper softening to enhance strength (hardness) of the steel sheet. Therefore, as necessary, Mo may be included within a range of 0.05% or less. In addition, when the lower limit of the amount of Mo is 0.01%, the above-described effect can be obtained preferably. On the other hand, if the amount of Mo is more than 0.05%, costs increase and the including effect saturates. In addition, if the amount of Mo is more than 0.05%, the workability, particularly cold workability of the steel sheet decreases, and thus, it becomes difficult to work the steel sheet into complex shape (for example, gear shape). Therefore, the upper limit of the amount of Mo is 0.05%. A preferable range of the amount of Mo is 0.01% to 0.05%.

(Ni: 0.05% or Less)

Ni (nickel) is an optional element effective for enhancing hardenability to enhance strength (hardness) and workability of the steel sheet. In addition, Ni is an optional element having an effect of preventing the molten metal embrittlement (Cu cracking) in a case of including Cu from occurring. Therefore, as necessary, Ni may be included within a range of 0.05% or less. In addition, when the lower limit of the amount of Ni is 0.01%, the above-described effect can be obtained preferably. On the other hand, if the amount of Ni is more than 0.05%, costs increases and the including effect saturates, and thus, the upper limit of the amount of Ni is 0.05%. A preferable range of the amount of Ni is 0.02% to 0.05%.

(Cr: 0.50% or Less)

Cr (chromium) is an element effective for enhancing hardenability to enhance strength (hardness) of the steel sheet. Therefore, as necessary, Cr may be included within a range of 0.50% or less. In addition, when the lower limit of the amount of Cr is 0.01%, the above-described effect can be obtained preferably. If the amount of Cr is more than 0.50%, costs increases and the including effect saturates. Therefore, the amount of Cr is controlled to 0.50% or less.

(B: 0.0050% or Less)

B (boron) is an element effective for enhancing hardenability to enhance strength (hardness) of the steel sheet. Therefore, as necessary, B may be included within a range of 0.0050% or less. In addition, when the lower limit of the amount of B is 0.0010%, the above-described effect can be obtained preferably. On the other hand, if the amount of B is more than 0.0050%, Boron-type compound forms to deteriorate the workability of the steel sheet, and thus, the upper limit thereof is 0.0050%. A preferable range of the amount of B is 0.0020% to 0.0040%.

Next, a method for manufacturing the steel sheet according to the present embodiment will be described.

For the example, similar to the general steel sheet, the raw material of the steel sheet according to the present embodiment is blast furnace molten iron, and a molten steel manufactured by performing converter refining and second refining is continuously-casted so as to be a slab, and then, the slab is hot-rolled, optionally cold-rolled, and/or quenched so as to be the steel sheet. In this regard, during the second refining in ladle after decarburization treatment in the converter, the composition of the steel is controlled while controlling inclusions is performed by adding Ca and REM. In addition to the blast furnace molten iron, molten steel obtained by melting raw material of iron scrap in electric furnace may be used as the raw material.

Ca and REM are added after controlling composition of other elements and floating $Al_2O_3$ caused by Al deoxidization from the molten steel. If $Al_2O_3$ remains in the molten metal in a huge amount, Ca and REM are consumed by reducing $Al_2O_3$. Therefore, the amounts of Ca and REM used for fixing S decrease, and thus, Ca and REM cannot sufficiently prevent from causing MnS.

Since vapor pressure of Ca is high, Ca may be added as Ca—Si alloy, Fe—Ca—Si alloy, Ca—Ni alloy, and the like in order to enhance yield ratio. In order to add the alloy, an alloy wire constructed from the alloy may be used. REM may be added as Fe—Si-REM alloy, misch metal, and the like. The misch metal is a mixture of rare-earth element. Specifically, the misch metal often includes 40% to 50% of Ce, and 20% to 40% of La. For example, a misch metal consisting of 45% of Ce, 35% of La, 9% of Nd, 6% of Pr, and other impurities is available.

Sequence of adding Ca and REM is not limited. On the other hand, if Ca is added after adding REM, there is a tendency that sizes of the inclusions slightly decrease. Therefore, it is preferable that Ca be added after adding REM.

$Al_2O_3$ forms after Al deoxidization and a part of the $Al_2O_3$ is clustered. However, when REM is added before adding Ca, a part of the cluster is reduced and dissolved, and thus, a size of the cluster can be decreased. On the other hand, if Ca is added before adding REM, $Al_2O_3$ may change to low-melting CaO—$Al_2O_3$ type inclusion and the above-described $Al_2O_3$ cluster may change to one coarse CaO—$Al_2O_3$ type inclusion. Therefore, it is preferable that Ca be added after adding REM.

EXAMPLES

Effects of on embodiment of the present invention will be described in further detail by examples. However, the condition in the examples is an example condition employed to confirm the operability and the effects of the present invention, so the present invention is not limited to the example condition. The present invention can employ various types of conditions as long as the conditions do not depart from the scope of the present invention and can achieve the object of the present invention.

300 tons of molten steel having composition shown in Table 2A was melted by using blast furnace molten iron as raw material, preliminary treating of molten iron, decarburizing treating in converter, and then ladle refining to control composition. In the ladle refining, at first, Al was added to perform deoxidization, next, composition of other elements such as Ti was controlled. Then, holding was performed during 5 minutes or longer to float $Al_2O_3$ caused by the Al deoxidization, REM was added, keeping was performed during 3 minutes to mix uniformly, and Ca was added. Misch metal was used as REM. REM elements included in the misch metal were 50% of Ce, 25% of La, 10% of Nd, and a remainder of the misch metal was impurities. Therefore, a ratio of each REM elements included in the obtained steel sheet is substantially equal to the ratio of each REM elements described above. Since vapor pressure of Ca was high, Ca—Si alloy was added to increase yield rate.

The above-described molten steel after refining was continuously-casted so as to be a slab having a thickness of 250 mm. Then, the slab was heated to 1250° C. and kept during 1 hour, hot-rolled with a finishing temperature of 850° C. to make the thickness as 5 mm, and thereafter, coiled with a coiling temperature of 580° C. After pickling the hot-rolled steel sheet, hot-rolled-sheet-annealing was performed at 700° C. during 72 hours. The hot-rolled steel sheet was quenched at 900° C. during 30 minutes, and further tempered at 100° C. during 30 minutes.

In the hot-rolled steel sheet obtained after quenching and tempering, composition and deformation behavior (ratio of size in long axis/size in short axis after rolling; aspect ratio) of inclusions were examined. 60 view fields were observed using optical microscope at 400-fold magnification (if shapes of the inclusions were measured in detail, at 1000-fold magnification) in which observed sections were cross-sections parallel to rolling direction and plate thickness direction. In each of the view fields, inclusions whose grain sizes were 1 μm or more (if shapes of the inclusions were spherical) or inclusions whose long axis were 1 μm or more (if shapes of the inclusions were deformed) were observed to categorize thereof as the A-type inclusions, the B-type inclusions and the C-type inclusions, and number densities thereof were measured. In addition, a number density of a carbonitrides including Ti which precipitated independently in the steel, had an angular shape, and had 5 μm or more of long side, was measured. Since the carbonitride including Ti differs from other C-type inclusion in shape and color, the carbonitride including Ti can be distinguished by observation. Alternatively, it is preferable that structure of the hot-rolled steel sheet is observed using EPMA (Electron Probe Micro Analysis) or SEM (Scanning Electron Microscope) having EDX (Energy Dispersive X-Ray Analysis). In this case, the carbonitrides including Ti, the composite inclusions including REM, MnS, and CaO—$Al_2O_3$ type inclusions in the inclusions can be identified.

Evaluation criteria of the inclusions are as follows.

Regarding number density of the A-type inclusions, number density of the B-type inclusions and number density of the C-type inclusions, in a case in which the number density was more than 6 pieces/mm$^2$, they were evaluated as B (Bad), in a case in which the number density was more than 4 pieces/mm$^2$ and 6 pieces/mm$^2$ or less, they were evaluated as G (Good), in a case in which the number density was more than 2 pieces/mm$^2$ and 4 pieces/mm$^2$ or less, they were evaluated as VG (Very Good), and in a case in which the number density was more than 2 pieces/mm$^2$ or less, they were evaluated as GG (Greatly Good).

Regarding coarse inclusions which were B-type or C-type and of which maximum length were 20 μm or more, in a case in which the coarse inclusions were more than 6 pieces/mm$^2$, they were evaluated as B (Bad), in a case in which the coarse inclusions were more than 3 pieces/mm$^2$ and 6 pieces/mm$^2$ or less, they were evaluated as G (Good), and in a case in which the coarse inclusions were 3 pieces/mm$^2$ or less, they were evaluated as VG (Very Good).

Regarding carbonitrides including Ti which existed independently in the steel and had Sum or more of long side, in a case in which the number density was more than 5 pieces/mm$^2$, they were evaluated as B (Bad), in a case in which the number density was more than 3 pieces/mm$^2$ and 5 pieces/mm$^2$ or less, they were evaluated as G (Good), and in a case in which the number density was 3 pieces/mm$^2$ or less, they were evaluated as VG (Very Good).

Tensile strength (MPa), charpy impact value (J/cm$^2$) at room temperature (about 25° C.), and hole expansibility (%) of the hot-rolled steel sheet obtained after quenching and tempering were evaluated. A steel sheet having 1200 MPa or more of tensile strength was recognized as a steel sheet satisfying evaluation criteria in tensile strength. The charpy impact value at room temperature indicates toughness and is one of indexes for evaluating workability of the steel sheet. In addition, toughness of the product obtained by working the steel sheet can be evaluated by the charpy impact value. A steel sheet having 6 J/cm$^2$ or more of charpy impact value at room temperature was recognized as a steel sheet satisfying evaluation criteria in toughness. The hole expansibility is another index for evaluating workability. At first, a punched hole having a diameter of 10 mm was made at a center of a steel sheet of 150 mm×150 mm, and then, the punched hole was stretched to expand by 60° of circular conic punch. When a cracking penetrating the steel thickness was occurred in the steel sheet by the stretching and expanding treatment, a hole diameter D (mm) was measured. Then, the hole expansion value λ (%) was calculated by an expression "$\lambda=(D-10)/10\times100$", and a steel sheet having 80% or more of λ (%) was recognized as a steel sheet satisfying evaluation criteria in hole expansibility.

In addition, a quantitative analysis for chemical composition of the obtained hot-rolled steel sheet was performed using ICP-AES (Inductively Coupled Plasma-Atomic Emission Spectrometry) or ICP-MS (Inductively Coupled Plasma-Mass Spectrometry). There was a case in which a trace of REM element among the REM elements is lower than analytical limit, and in this case, an amount of the trace of REM was recognized to be proportional to the amount in misch metal (50% of Ce, 25% of La, and 10% of Nd) and was calculated by using a ratio with respect to the analysis value of Ce, which has the largest amount.

Results are shown in Table 2B. In the table, a value being out of range of the present invention is underlined. All examples had construction satisfying the range of the present invention, and thus, was excellent in the tensile strength, and the workability indicated by the charpy impact value and the hole expansibility λ. On the other hand, comparative examples did not satisfy the condition defined according to the present invention, and thus, did not have sufficient tensile strength or sufficient workability.

Regarding comparative example 1, the amount of Ca was lower than the lower limit thereof, and thus, inclusions which hardly included Ca formed. Therefore, in comparative example 1, many B-type inclusions, C-type inclusions, and coarse inclusions formed and the evaluation of the number density of the B-type inclusions+the C-type inclusions and the evaluation of the number density of the coarse inclusions were "B". In addition, nozzle clogging occurred during casting of the comparative example 1.

Regarding comparative example 2, the amount of Ca was higher than the upper limit thereof, and thus, coarse CaO—$Al_2O_3$ type low-temperature oxides formed. Therefore, the evaluation of the number density of the A-type inclusions, the evaluation of the number density of the B-type inclusions+the C-type inclusions, and the evaluation of the number density of the coarse inclusions were "B".

Regarding comparative example 3, the amount of REM was lower than the lower limit thereof and the expression 3 was not satisfied, and thus, many coarse carbonitrides including Ti formed independently in the matrix. Therefore, the evaluation of the number density of the carbonitrides including Ti was "B".

Regarding comparative example 4, the amount of REM was higher than the upper limit thereof, and thus, the evaluation of the number density of the B-type inclusions+the C-type inclusions and the evaluation of the number density of the coarse inclusions were "B". In addition, nozzle clogging occurred during casting of the comparative example 4.

Regarding comparative example 5, the value of the right side of the expression 1 was lower than 0.3, and thus, the evaluation of the number density of the A-type inclusions was "B". In addition, the amount of C of the comparative example 5 was excess, and thus, the workability thereof was low. Therefore, the impact value of the comparative example 5 was insufficient.

Regarding comparative example 6, the expression 2 was not satisfied, and thus, the evaluation of the number density of the B-type inclusions+the C-type inclusions was "B".

Regarding comparative example 7, the amount of C was insufficient, and thus, the tensile strength was insufficient.

Regarding comparative example 8, although the number density of the inclusions was an adequate level, the amount of C was excess, and thus, the workability was deteriorated. Therefore, the hole expansibility of the comparative example 8 was non-acceptance.

Regarding comparative example 9, the amount of S was excess, and thus, coarse MnS inclusions formed and the evaluation of the number density of the A-type inclusions was "B". In addition, the impact value and the hole expansibility of the comparative example 9 were insufficient.

Regarding comparative example 10, the amount of Ti was excess, and thus, the evaluation of the number density of the carbonitrides including Ti was "B". Therefore, the impact value and the hole expansibility of the comparative example 10 were insufficient.

Regarding comparative example 11, the amount of Ca was excess, and thus, coarse inclusions of which CaO content was high formed and elongated. Therefore, the evaluation of the number density of the A-type inclusions and the evaluation of the number density of the B-type inclusions and the C-type inclusions were "B". In addition, regarding comparative example 11, CaO content was high, and thus, an effect of adhering the carbonitrides including Ti on the surface of the oxides was deteriorated. Therefore, the evaluation of the number density of the carbonitrides including Ti of the comparative example 11 was "B". As a result, the impact value and the hole expansibility of the comparative example 11 were insufficient.

Regarding comparative example 12, the amount of REM was insufficient, and thus, an effect of adhering the carbonitrides including Ti on the surface of the oxides was deteriorated. Therefore, the evaluation of the number density of the carbonitrides including Ti of the comparative example 12 was "B". As a result, the impact value and the hole expansibility of the comparative example 12 were insufficient.

Regarding comparative example 13, the amount of REM was excess, and thus, the evaluation of the number density of the coarse inclusions was "B". Therefore, the impact value and the hole expansibility of the comparative example 13 were insufficient.

Regarding comparative example 14, the amount of Mo was excess, and thus, although the evaluation of the number density of the inclusions was good, the workability was deteriorated. Therefore, the impact value and the hole expansibility of the comparative example 14 were insufficient.

Regarding comparative example 15, the expression 1 was not satisfied, and thus, the evaluation of the number density of the A-type inclusions was "B". Therefore, the impact value and the hole expansibility of the comparative example 15 were insufficient.

Regarding comparative example 16, the expression 2 was not satisfied, and thus, the evaluation of the number density of the B-type inclusions+the C-type inclusions was "B". Therefore, the impact value and the hole expansibility of the comparative example 16 were insufficient.

[Table 2A]

[Table 2B]

INDUSTRIAL APPLICABILITY

The amount of C, the amount of Ca, and the amount of REM of the steel sheet according to the present invention satisfy the expression "$0.3000 \leq \{Ca/40.88+(REM/140)/2\}/(S/32.07)$" and the expression "$Ca \leq 0.0058-0.0050 \times C$". Therefore, the number density of the A-type inclusions having 1 μm or more of long side of the steel sheet according to the present invention is limited to 6 pieces/$mm^2$ or less, and the total number density of the B-type inclusions and the C-type inclusions having 1 μm or more of long side of the steel sheet according to the present invention is limited to 6 pieces/$mm^2$ or less. In addition, Ti carbonitrides of the steel sheet according to the present invention, which have 5 μm or more of long side and exists independently, is limited to 5 pieces/$mm^2$ or less. According to the above-described embodiment, the A-type inclusions, the B-type inclusions, and the C-type inclusions in the steel are decreased and the coarse carbonitrides including Ti existing independently is prevented from forming, and thus, a steel sheet excellent in workability becomes available and the present invention has high industrial applicability. The carbon steel sheet according to the present invention can be used for manufacturing mechanical component having various shapes such as gears, a clutch, and a washer of a vehicle, and the like.

TABLE 1

| C | Si | Mn | P | S | Al | Ti | Ca | REM | T · O | N (mass %) |
|---|---|---|---|---|---|---|---|---|---|---|
| 0.45 | 0.20 | 0.65 | 0.010 | 0.001~0.007 | 0.03 | 0.007 | 0.0005~0.003 | 0.001~0.005 | <0.0010~0.0033 | <0.0010~0.0022 |

TABLE 2A

| | | CHEMICAL COMPOSITION (mass %) | | | | | | | | | | | | |
|---|---|---|---|---|---|---|---|---|---|---|---|---|---|---|
| | | C | Si | Mn | P | S | Al | Ti | Ca | REM | T · O | N | Cu | Nb |
| max. | | <0.50 | 0.60 | 0.90 | 0.020 | 0.0070 | 0.070 | 0.050 | 0.0040 | 0.0050 | 0.0040 | 0.0075 | 0.05 | 0.05 |
| min. | | 0.25< | 0.10 | 0.40 | — | — | 0.003 | — | 0.0005 | 0.0003 | — | — | 0 | 0 |
| EXAMPLE | 1 | 0.43 | 0.21 | 0.66 | 0.010 | 0.0015 | 0.035 | 0.010 | 0.0015 | 0.0013 | 0.0012 | 0.0031 | 0.05 | |
| | 2 | 0.26 | 0.16 | 0.43 | 0.009 | 0.0021 | 0.025 | 0.019 | 0.0008 | 0.0030 | 0.0018 | 0.0027 | | 0.05 |
| | 3 | 0.49 | 0.22 | 0.71 | 0.008 | 0.0027 | 0.030 | 0.007 | 0.0011 | 0.0026 | 0.0013 | 0.0031 | | |
| | 4 | 0.35 | 0.11 | 0.88 | 0.011 | 0.0033 | 0.029 | 0.050 | 0.0020 | 0.0048 | 0.0037 | 0.0027 | | |
| | 5 | 0.42 | 0.28 | 0.53 | 0.005 | 0.0005 | 0.068 | 0.024 | 0.0024 | 0.0025 | 0.0021 | 0.0028 | | |
| | 6 | 0.31 | 0.59 | 0.62 | 0.007 | 0.0026 | 0.025 | 0.031 | 0.0005 | 0.0034 | 0.0028 | 0.0024 | | |
| | 7 | 0.48 | 0.48 | 0.45 | 0.008 | 0.0069 | 0.041 | 0.004 | 0.0029 | 0.0013 | 0.0023 | 0.0020 | | |
| | 8 | 0.33 | 0.48 | 0.45 | 0.019 | 0.0018 | 0.041 | 0.011 | 0.0040 | 0.0013 | 0.0023 | 0.0020 | | |
| | 9 | 0.26 | 0.19 | 0.40 | 0.009 | 0.0020 | 0.033 | 0.005 | 0.0012 | 0.0008 | 0.0021 | 0.0073 | | |
| | 10 | 0.47 | 0.23 | 0.57 | 0.013 | 0.0043 | 0.047 | 0.012 | 0.0016 | 0.0003 | 0.0009 | 0.0029 | | |
| | 11 | 0.27 | 0.21 | 0.59 | 0.012 | 0.0030 | 0.034 | 0.010 | 0.0015 | 0.0010 | 0.0018 | 0.0033 | | |
| | 12 | 0.44 | 0.20 | 0.65 | 0.011 | 0.0023 | 0.026 | 0.005 | 0.0019 | 0.0006 | 0.0035 | 0.0037 | | |
| | 13 | 4.41 | 0.19 | 0.62 | 0.012 | 0.0018 | 0.031 | 0.009 | 0.0018 | 0.0014 | 0.0018 | 0.0034 | | |
| COMPARATIVE EXAMPLE | 1 | 0.45 | 0.30 | 0.50 | 0.010 | 0.0020 | 0.030 | 0.012 | 0.0004 | 0.0033 | 0.0020 | 0.0025 | 0.05 | |
| | 2 | 0.31 | 0.22 | 0.30 | 0.001 | 0.0016 | 0.020 | 0.007 | 0.0042 | 0.0016 | 0.0018 | 0.0023 | | 0.04 |
| | 3 | 0.40 | 0.20 | 0.40 | 0.008 | 0.0025 | 0.025 | 0.021 | 0.0021 | 0.0002 | 0.0026 | 0.0017 | | |
| | 4 | 0.25 | 0.17 | 0.25 | 0.007 | 0.0027 | 0.024 | 0.029 | 0.0015 | 0.0055 | 0.0015 | 0.0022 | | |
| | 5 | 0.50 | 0.31 | 0.49 | 0.012 | 0.0064 | 0.031 | 0.004 | 0.0022 | 0.0005 | 0.0018 | 0.0021 | | |
| | 6 | 0.49 | 0.25 | 0.35 | 0.009 | 0.0022 | 0.027 | 0.010 | 0.0036 | 0.0020 | 0.0016 | 0.0025 | | |
| | 7 | 0.24 | 0.22 | 0.61 | 0.010 | 0.0028 | 0.031 | 0.007 | 0.0015 | 0.0018 | 0.0017 | 0.0036 | | |
| | 8 | 0.50 | 0.21 | 0.60 | 0.010 | 0.0029 | 0.021 | 0.007 | 0.0016 | 0.0017 | 0.0019 | 0.0040 | | |
| | 9 | 0.42 | 0.25 | 0.55 | 0.012 | 0.0073 | 0.030 | 0.010 | 0.0027 | 0.0022 | 0.0021 | 0.0041 | | |
| | 10 | 0.43 | 0.24 | 0.57 | 0.013 | 0.0037 | 0.029 | 0.053 | 0.0024 | 0.0024 | 0.0022 | 0.0039 | | |
| | 11 | 0.28 | 0.23 | 0.59 | 0.014 | 0.0033 | 0.031 | 0.013 | 0.0043 | 0.0023 | 0.0024 | 0.0037 | | |
| | 12 | 0.39 | 0.25 | 0.61 | 0.009 | 0.0022 | 0.033 | 0.007 | 0.0021 | 0.0002 | 0.0012 | 0.0029 | | |
| | 13 | 0.41 | 0.26 | 0.60 | 0.010 | 0.0025 | 0.037 | 0.006 | 0.0022 | 0.0053 | 0.0033 | 0.0045 | | |
| | 14 | 0.48 | 0.28 | 0.62 | 0.011 | 0.0024 | 0.034 | 0.008 | 0.0019 | 0.0024 | 0.0025 | 0.0038 | | |
| | 15 | 0.42 | 0.19 | 0.63 | 0.010 | 0.0030 | 0.028 | 0.007 | 0.0007 | 0.0013 | 0.0016 | 0.0035 | | |
| | 16 | 0.46 | 0.20 | 0.64 | 0.012 | 0.0020 | 0.031 | 0.006 | 0.0038 | 0.0019 | 0.0018 | 0.0031 | | |

| | | CHEMICAL COMPOSITION (mass %) | | | | | | | |
|---|---|---|---|---|---|---|---|---|---|
| | | V | Mo | Cr | Ni | B | RIGHT SIDE OF EXPRESSION 1 | RIGHT SIDE OF EXPRESSION 2 | LEFT SIDE OF EXPRESSION 3 |
| max. | | 0.05 | 0.05 | 0.50 | 0.05 | 0.005 | — | — | — |
| min. | | 0 | 0 | 0 | 0 | 0 | 0.3000 | AMOUNT OF Ca | 0.00000 |
| EXAMPLE | 1 | | | 0.05 | 0.05 | | 0.8990 | 0.0037 | 0.00009 |
| | 2 | 0.05 | | 0.03 | | | 0.4680 | 0.0045 | 0.00027 |
| | 3 | | 0.05 | | | | 0.4360 | 0.0034 | 0.00025 |
| | 4 | | | 0.50 | | | 0.6511 | 0.0041 | 0.00039 |
| | 5 | | | | | 0.0048 | 4.4114 | 0.0037 | 0.00019 |
| | 6 | | 0.03 | 0.02 | | | 0.3033 | 0.0043 | 0.00026 |
| | 7 | | | | 0.02 | | 0.3578 | 0.0034 | 0.00002 |
| | 8 | | | | | 0.0015 | 1.8603 | 0.0042 | 0.00002 |
| | 9 | | | | | | 0.5257 | 0.0045 | −0.00003 |
| | 10 | | | | | | 0.3066 | 0.0035 | −0.00001 |
| | 11 | | | | | | 0.4394 | 0.0045 | 0.00002 |
| | 12 | | | | | | 0.6907 | 0.0036 | −0.00014 |
| | 13 | | | | | | 0.8889 | 0.0038 | 0.00007 |
| COMPARATIVE EXAMPLE | 1 | | | | 0.02 | | 0.3479 | 0.0036 | 0.00030 |
| | 2 | 0.02 | | | | | 2.2143 | 0.0043 | 0.00009 |
| | 3 | | 0.03 | | | | 0.6811 | 0.0038 | −0.00014 |
| | 4 | | | 0.50 | | | 0.6772 | 0.0046 | 0.00061 |
| | 5 | | | | | 0.0025 | 0.2839 | 0.0033 | −0.00005 |
| | 6 | | | | | | 1.4108 | 0.0034 | 0.00015 |
| | 7 | | | | | | 0.5020 | 0.0046 | 0.00013 |
| | 8 | | | | | | 0.5084 | 0.0033 | 0.00010 |
| | 9 | | | | | | 0.3303 | 0.0037 | 0.00015 |

TABLE 2A-continued

| | | | | |
|---|---|---|---|---|
| 10 | | 0.5931 | 0.0037 | 0.00017 |
| 11 | | 1.1221 | 0.0044 | 0.00015 |
| 12 | | 0.7740 | 0.0039 | −0.00005 |
| 13 | | 0.9463 | 0.0038 | 0.00048 |
| 14 | 0.06 | 0.7476 | 0.0034 | 0.00015 |
| 15 | | 0.2362 | 0.0037 | 0.00007 |
| 16 | | 1.6286 | 0.0035 | 0.00013 |

IN THE TABLE, A BLANK CELL EXPRESSES THAT AN AMOUNT OF THE ELEMENT THEREOF IS EQUAL TO OR LOWER THAN A LEVEL OF IMPURITY.
IN THE TABLE, AN UNDERLINED VALUE IS OUT OF RANGE OF THE PRESENT APPLICATION.

TABLE 2B

| | | EVALUATION OF NUMBER DENSITY OF INCLUSION | | | | CHARACTERISTIC VALUE | | | |
|---|---|---|---|---|---|---|---|---|---|
| | | A-TYPE | B-TYPE AND C-TYPE | COARSE INCLUSION | CARBO-NITRIDE INCLUDING Ti | TENSILE STRENGTH (MPa) | CHARPY IMPACT VALUE ($J/cm^2$) | HOLE EXPANSIBILITY λ (%) | REMARKS |
| EXAMPLE | 1 | GG | VG | VG | VG | 1600 | 13.0 | 125 | |
| | 2 | VG | VG | VG | VG | 1250 | 11.0 | 131 | |
| | 3 | VG | VG | VG | VG | 1750 | 10.5 | 115 | |
| | 4 | VG | G | VG | G | 1450 | 13.0 | 131 | |
| | 5 | GG | G | VG | VG | 1650 | 18.0 | 167 | |
| | 6 | G | VG | VG | G | 1450 | 9.2 | 118 | |
| | 7 | VG | G | VG | G | 1700 | 9.8 | 124 | |
| | 8 | GG | G | VG | VG | 1500 | 15.0 | 138 | |
| | 9 | VG | VG | VG | VG | 1300 | 10.0 | 112 | |
| | 10 | G | G | VG | VG | 1750 | 9.3 | 108 | |
| | 11 | VG | VG | VG | VG | 1350 | 12.2 | 135 | |
| | 12 | G | G | VG | VG | 1600 | 11.5 | 107 | |
| | 13 | VG | VG | VG | VG | 1600 | 11.8 | 112 | |
| COMPARATIVE EXAMPLE | 1 | VG | B | B | VG | 1700 | 7.2 | 71 | NOZZLE CLOGGING OCCURRED |
| | 2 | B | B | B | G | 1400 | 6.3 | 72 | |
| | 3 | G | G | G | B | 1650 | 5.4 | 69 | |
| | 4 | VG | B | B | VG | 1200 | 5.8 | 59 | NOZZLE CLOGGING OCCURRED |
| | 5 | B | G | VG | G | 1750 | 5.8 | 75 | |
| | 6 | GG | B | G | VG | 1600 | 8.6 | 67 | |
| | 7 | VG | VG | VG | VG | 1150 | 12.3 | 105 | |
| | 8 | VG | G | VG | VG | 1700 | 7.8 | 77 | |
| | 9 | B | G | G | VG | 1500 | 5.2 | 55 | |
| | 10 | VG | G | G | B | 1550 | 5.5 | 42 | |
| | 11 | B | B | B | G | 1350 | 5.0 | 47 | |
| | 12 | VG | G | VG | B | 1550 | 5.7 | 69 | |
| | 13 | GG | G | B | VG | 1550 | 4.5 | 59 | |
| | 14 | VG | G | VG | VG | 1800 | 5.5 | 50 | |
| | 15 | B | VG | VG | VG | 1550 | 4.5 | 45 | |
| | 16 | GG | B | G | VG | 1650 | 5.8 | 72 | |

IN THE TABLE, AN UNDERLINED VALUE IS OUT OF RANGE OF THE PRESENT APPLICATION.

The invention claimed is:

1. A steel sheet, wherein a chemical composition comprises, by mass %:

C: more than 0.25% and 0.48% or less;

Si: 0.10% to 0.60%;

Mn: 0.40% to 0.90%;

Al: 0.003% to 0.070%;

Ca: 0.0005% to 0.0040%;

REM: 0.0003% to 0.0050%;

Cu: 0% to 0.05%;

Nb: 0% to 0.05%;

V: 0% to 0.05%;

Mo: 0% to 0.05%;

Ni: 0% to 0.05%;

Cr: 0% to 0.50%;

B: 0% to 0.0050%;

P: limited to 0.020% or less;

S: limited to 0.0070% or less;

Ti: limited to 0.050% or less;

O: limited to 0.0040% or less;

N: limited to 0.0075% or less; and remainder including iron and impurity, amounts of each elements by mass % in the chemical composition satisfy both of expression 1 and expression 2, a number density of carbonitrides including Ti which exists independently and has a long side of 5 μm or more is limited to 5 pieces/$mm^2$ or less, $$0.3000 \leq \{Ca/40.88+(REM/140)/2\}/(S/32.07): \quad \text{expression 1, and}$$

$$Ca \leq 0.0058-0.0050 \times C: \quad \text{expression 2,}$$

a number density of A-type inclusions, which is defined as inclusions of which an aspect ratio is 3.0 or more, is 6 pieces/$mm^2$ or less, a total number density of B-type inclusions, which are defined as inclusions which form inclusion groups in which three or more of the inclusions form a line along the working direction, in which clearance between the inclusions is 50 μm or less, and in which the aspect ratio of the inclusions are less than 3.0, and C-type inclusions, which are defined as inclusions of which an aspect ratio is 3.0 or less, and which disperse in a random manner, is 6 pieces/$mm^2$ or less, and a number density of coarse inclusions, which is defined as inclusions which are B-type or C-type and of which maximum length are 20 μm or more, is 6 pieces/$mm^2$ or less.

2. The steel sheet according to claim 1, wherein the chemical composition further comprises one or more of, by mass %:

Cu: 0.01% to 0.05%;

Nb: 0.01% to 0.05%;

V: 0.01% to 0.05%;

Mo: 0.01% to 0.05%;

Ni: 0.01% to 0.05%;

Cr: 0.01% to 0.50%; and

B: 0.0010% to 0.0050%.

3. The steel sheet according to claim 1, wherein the steel sheet further includes a composite inclusion which includes Al, Ca, O, S, and REM, and an inclusion in which the carbonitride including Ti is adhered on the composite inclusion.

4. The steel sheet according to claim 1, wherein the amounts of the each elements by mass % in the chemical composition satisfy expression 3, $$18\times(REM/140)-O/16\geq 0: \quad \text{expression 3.}$$

5. The steel sheet according to claim 3, wherein the amounts of the each elements by mass % in the chemical composition satisfy expression 4, $$18\times(REM/140)-O/16\geq 0: \quad \text{expression 4.}$$

6. The steel sheet according to claim 2, wherein the steel sheet further includes a composite inclusion which includes Al, Ca, O, S, and REM, and an inclusion in which the carbonitride including Ti is adhered on the composite inclusion.

7. The steel sheet according to claim 2, wherein the amounts of the each elements by mass % in the chemical composition satisfy expression 3, $$18\times(REM/140)-O/16\geq 0: \quad \text{expression 3.}$$

8. The steel sheet according to claim 6, wherein the amounts of the each elements by mass % in the chemical composition satisfy expression 4, $$18\times(REM/140)-O/16\geq 0: \quad \text{expression 4.}$$

9. The steel sheet according to claim 1, wherein

C: more than 0.25% and 0.47% or less.

10. The steel sheet according to claim 1, wherein

C: more than 0.25% and 0.44% or less.

11. The steel sheet according to claim 1, wherein the steel sheet is obtained by a manufacturing method comprising:

manufacturing a molten steel by converter refining and second refining a blast furnace molten iron;

continuously-casting the molten steel so as to be a slab; and hot rolling the slab;

during the second refining in a ladle after a decarburization treatment in a converter, the composition of the molten steel is controlled while controlling inclusions by adding Ca and REM, wherein Ca and REM are added after controlling the composition of other elements and floating $Al_2O_3$ caused by Al deoxidization from the molten steel, and wherein Ca is added after adding REM.

12. The steel sheet according to claim 1, wherein the steel sheet has 1200 MPa or more of tensile strength, the steel sheet has 6 J/$cm^2$ or more of charpy impact value at room temperature, and the steel sheet has 80% or more of hole expansion value λ, in which the hole expansion value λ is evaluated by making a punched hole having a diameter of 10 mm at a center of the steel sheet of 150 mm×150 mm having a thickness of 5 mm, stretching the punched hole to expand by 60° of circular conic punch, measuring a hole diameter D (mm) when a cracking penetrating the steel thickness occurs in the steel sheet by the stretching and expanding, and calculating the hole expansion value λ by an expression $\lambda=(D-10)/10\times 100$.

* * * * *